United States Patent [19]

Haydon, deceased et al.

[11] Patent Number: 4,489,297

[45] Date of Patent: Dec. 18, 1984

[54] MAGNETIC SWITCH

[76] Inventors: Arthur W. Haydon, deceased, late of Middlebury, Conn.; by Jean F. Haydon, executor, 657 Breakneck Hill, Middlebury, Conn. 06762

[21] Appl. No.: 357,868

[22] Filed: Mar. 15, 1982

[51] Int. Cl.[3] ..... H01H 36/00

[52] U.S. Cl. ..... 335/207; 200/67 F

[58] Field of Search ..... 335/207, 281; 200/67 F

[56] References Cited

U.S. PATENT DOCUMENTS

| | | | |
|---|---|---|---|
| 2,521,723 | 9/1950 | Hubbell | 335/207 |
| 3,056,000 | 9/1962 | Lucas | 335/207 |
| 3,062,932 | 11/1962 | Korsgren, Sr. et al. | 200/67 |
| 3,236,964 | 2/1966 | Sommer | 335/196 |
| 3,273,091 | 9/1966 | Wales, Jr. | 335/207 |
| 3,447,110 | 5/1969 | Dotto | 335/207 |
| 4,359,706 | 11/1982 | Flack | 335/281 |

*Primary Examiner*—Harold Broome

*Attorney, Agent, or Firm*—Lee C. Robinson, Jr.

[57] ABSTRACT

A magnetic switch has a fixed contact, a movable contact, and a flat, flexible blade supporting the movable contact, and movable between first and second positions in which the contacts are respectively engaged and disengaged. A blade magnet is affixed to the free end of the blade and is movable with it. An actuator is selectively movable to first and second positions corresponding to the first and second positions of the blade. An actuator magnet is positioned on the actuator in facing opposition to the blade magnet. When the actuator is moved to its first and second positions, one pole of the actuator magnet is disposed beyond the position of the blade magnet when the blade is in its respective first and second position. Thus, when the actuator is moved to one of its first and second positions, the blade magnet is repelled by the actuator magnet to drive the blade, with snap action, to the other of its first and second positions.

36 Claims, 15 Drawing Figures

FIG. 10
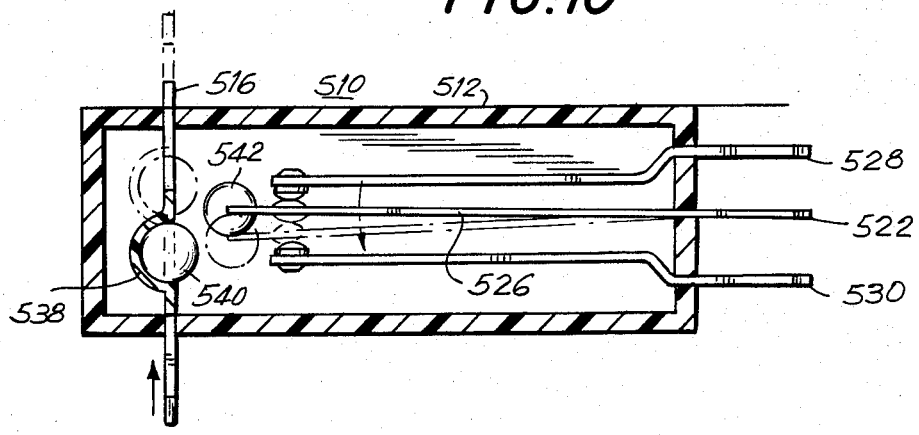
FIG. 12
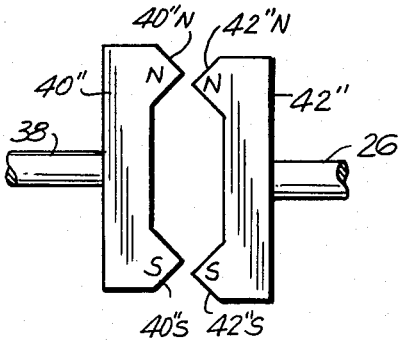
FIG. 11
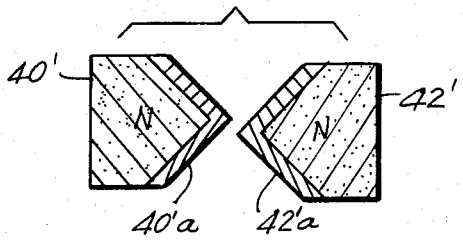
FIG. 13
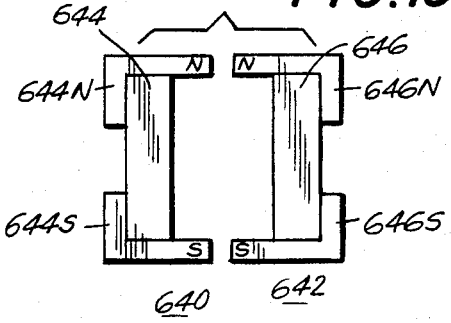
FIG. 14
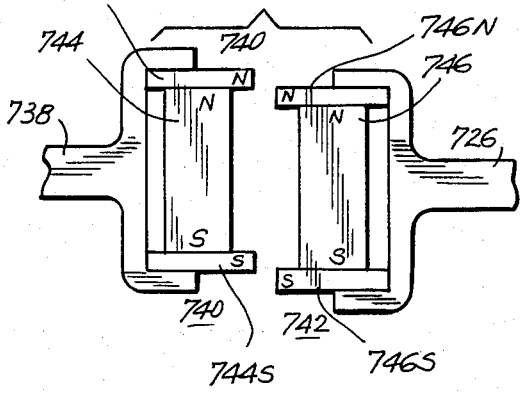
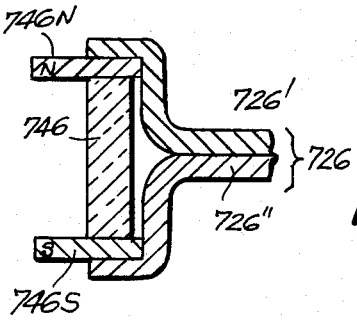
FIG. 15

MAGNETIC SWITCH

BACKGROUND OF THE INVENTION

The present invention relates to electrical switches, and is particularly directed to switches having improved means for effecting actuation thereof.

In a typical switch, for example, as shown in U.S. Pat. No. 3,062,932, fixed contacts are mounted within a switch housing, and a movable contact is mounted on an elongated, flat flexible conductive blade within the housing. An actuating arm, selectively displaced by a plunger, rocker, bat, or other switch handle, pushes against the blade to make or break engagement between the fixed and movable contacts.

Such switches can readily be constructed to be small, positive in action, and rugged. Further, the switches can be made capable of snap action.

However, mechanical contact between the actuator and the blade can eventually cause the switch to wear out or break. Further, direct mechanical contact of the actuator can give an electrical shock to a person turning the switch on or off, especially if rather high voltages are used. In addition, direct contact between the actuator and the blade can affect an instrument reading for instrumentation connected in circuit with the switch, for example, due to the presence of a person's hand on the switch.

OBJECTS AND SUMMARY OF THE INVENTION

A desired object of this invention is to provide a rugged, reliable, and long-lasting switch.

More particularly, it is an object of this invention to provide such a switch avoiding mechanical contact of the switch actuator and the electrical elements of the switch.

Further, it is an object of this invention to provide a switch achieving fast and reliable snap-action operation.

It is additional object of this invention to provide a switch actuation mechanism readily adaptable for use in any of a multitude of switch types.

In accordance with a number of preferred embodiments of this invention, a magnetically actuated switch is provided with at least a pair of switch terminals. A fixed contact and a movable contact are respectively connected to these terminals. A movable support assembly, which can favorably be a flat, flexible blade mounted at one end in the switch housing, supports the movable contact, and is movable between a first position wherein the fixed and movable contacts are electrically engaged, and a second position wherein the fixed and movable contacts are disengaged. A driven magnet is affixed to and is movable with the support assembly, for example, by being mounted at the free end of the blade. A movable actuator is selectively movable between first and second positions corresponding to the first and second positions of the support assembly. Finally, an actuator magnet is affixed onto and is movable with the actuator, and a driven magnet is mounted on the movable actuator. These magnet are disposed to generally face one another, with a magnetic pole of the actuator magnet facing a like pole of the driven magnet. These magnets are further disposed such that when the actuator is in its first and second positions, the actuator magnet is positioned beyond the corresponding positions of the driven magnet, that is, its positions wherein the support assembly is in its first and second positions, respectively. Consequently, when the actuator is moved to one of its first and second positions, the driven magnet is repulsed by the actuator magnet to drive the support assembly to the other of its corresponding first and second positions.

The switch of this invention can be formed as a rocker switch, plunger switch, toggle switch, momentary-contact switch, or any of a multitude of other switch configurations. Further, the switch of this invention can be constructed as a double-pole, single-throw switch, a single-pole, double-throw switch, a double-pole, double-throw switch, or as any of many other types, as required for any particular application.

In several preferred embodiments, the switch magnets each include only a single pole member facing a respective single pole member of the other switch magnet. In such case, the driven magnet can be placed in close proximity to the movable contact, and magnetic flux flowing out from the reverse pole of the driven magnet will act to quench any electrical arcing at the switch contact. This reduction in arcing will prolong switch life and minimize discharge disturbances such as radio interference.

In many alternative embodiments, the switch magnets can each have a north pole and a south pole arranged in line in the direction of motion of the magnet, i.e., the direction of motion of the associated actuator or support assembly, with each such pole generally facing the like pole of the other magnet arrangement. With such an arrangement, one of the poles of the driven magnet is not only repelled by the like of the actuator magnet, but is additionally attracted to the unlike pole of the actuator magnet. Thus, when this type of switch is actuated, the driven magnet and the support assembly associated therewith are rapidly snapped to the driven position and the movable support assembly is reliably held in that position.

It should be appreciated that the magnetic arrangement of this invention avoids direct mechanical contact between the actuator and the electrical elements of the switch. Also, because the facing poles of the actuator magnet and of the driven magnet are of like polarity, the switch of this invention is rapidly actuated, with snap action.

Many other embodiments of this invention are possible, and the following description of selected illustrative embodiments is offered, to be considered with the accompanying drawings, from which additional aspects and advantages of this invention will become apparent.

BRIEF DESCRIPTION OF THE DRAWINGS

FIG. 10 shows another switch according to this invention in which ceramic magnets are employed.

FIGS. 11–15 illustrate alternative arrangements of the actuator magnet and driven magnet which can be employed in embodiments of this invention.

DETAILED DESCRIPTION OF SEVERAL PREFERRED EMBODIMENTS

Figure 1:
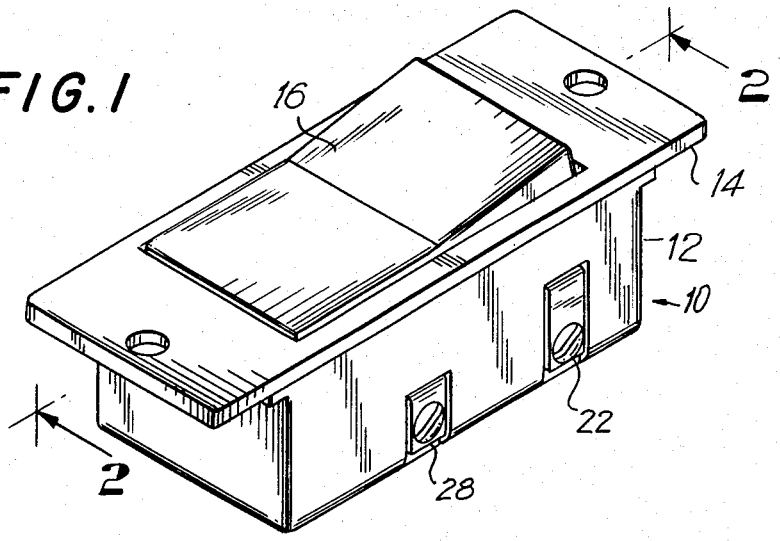
FIG. 1 is a perspective view of a rocker switch according to this invention.

A rocker switch mechanism constructed according to this invention will now be described with reference to the drawings, and initially to FIGS. 1–3 thereof.

A rocker switch 10 includes a housing body 12 of plastic or other insulating material, and a cover plate 14. A rocker actuator 16 is pivotally mounted in the cover plate 14 and is rockable between the two positions respectively shown in FIGS. 2 and 3. The actuator 16 has a pair of flanges 18 and 20 that lodge against the underside of the cover plate 14 to limit travel of the rocker actuator 16.

A common switch terminal 22 extends from the exterior of the housing body 12 to the interior thereof and provides a mount 24 for a fixed end of a flat, flexible conductive switch blade 26.

A normally-open terminal 28 and a normally-closed terminal 30 extend from the exterior to the interior of the housing body 12, and these respectively support a normally-open contact 32 and a normally-closed contact 34, disposed below and above the blade 26. Accordingly, a movable contact 36 is mounted on the blade 26 to contact the normally-closed contact 34 when the blade is in the position illustrated in FIG. 2, but to break contact therewith and instead make contact with the normally-open contact 32 when the blade 26 is deflected into the position shown in FIG. 3.

An actuator arm 38 is fixedly mounted on the rocker actuator 16 and depends therefrom into the interior of the housing body 12. An actuator magnet 40 is attached to an end of the arm 38 and has a north pole facing toward the blade 26. A corresponding magnet 42 is mounted at the free end of the blade 26 with its north pole facing the north pole of the actuator magnet 40.

Figure 2:
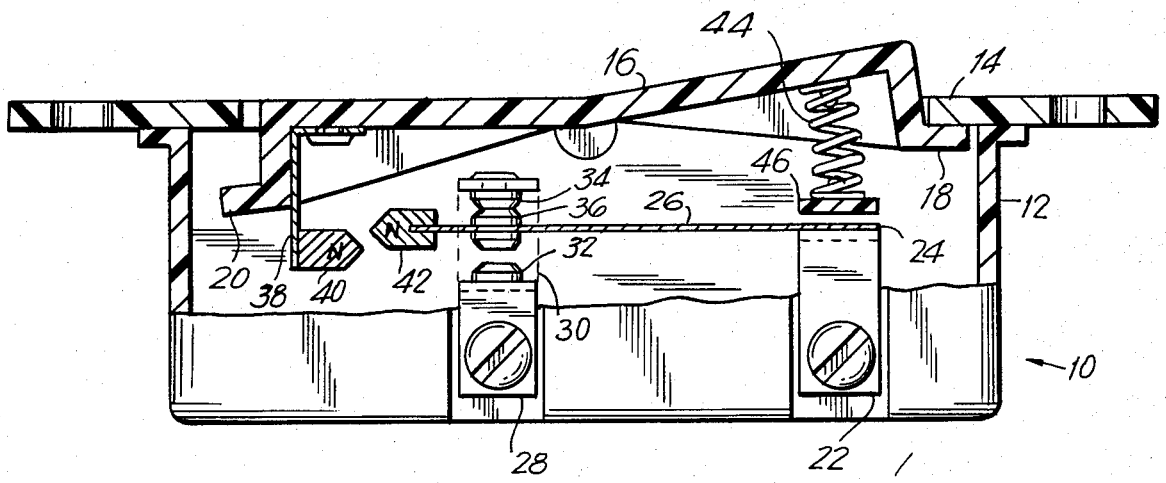
FIGS. 2 and 3 are side elevational views, partially cut away, of the rocker switch of FIG. 1.
Figure 3:
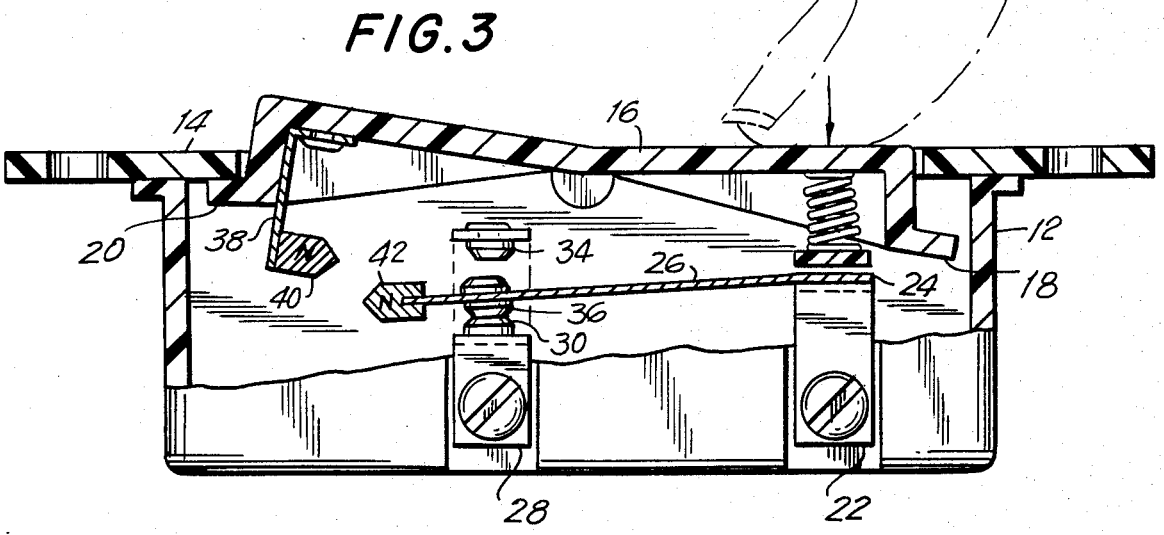

An optional spring 44 is provided between the rocker actuator 16 and a spring mount 46 formed in the housing body 12 and this spring 44 serves normally to bias the rocker actuator 16 to the position illustrated in FIG. 2.

In this embodiment, the magnets 40 and 42 have their north poles formed generally as a wedge, in cross section, so that the magnetic flux is concentrated at a nose point thereof. Consequently, in the normal position (FIG. 2), because the north pole of the actuator magnet 40 is disposed below the lowest deflected position of the north pole of the blade magnet 42 (i.e., as shown in FIG. 3), the magnet 42 and the associated blade 26 and contact 36 are deflected to, and held by magnetic repulsive force at the normal position illustrated in FIG. 2. However, if the switch 10 is actuated by deflecting the rocker actuator to the position shown in FIG. 3, the north pole of the actuator magnet 40 will be moved above the normal (i.e., FIG. 2) position of the blade magnet 42. Consequently, the blade magnet 42 will be deflected downward and will snap into the actuated position (FIG. 3) wherein the movable contact 36 engages the normally-open contact 32 and disengages with the normally-closed contact 34.

Later, when the rocker actuator 16 returns to the normal (i.e., FIG. 2) position, the actuator magnet 40 will be below the actuated position of the actuator magnet 42, and will cause the same to be repulsed upward to the normal (i.e., FIG. 2) position.

Because the magnets 40 and 42 repel one another, the blade 26 is rapidly transfered between its normal and actuated positions in response to movement of the rocker actuator 16. Also, the continuous repulsive force between the magnets 40 and 42 causes the driven blade magnet 42 to push the movable contact 36 against the contacted one of the normally-opened and normally-closed contacts 32 and 34 until such time as the actuator magnet 40 is positively moved beyond the position of the blade magnet 42. That is, in order to cause the blade 26 to change positions, the actuator must be positively moved through a "dead center" position.

Furthermore, even in the absence of the spring 44, the driven blade magnet 42, by means of the repulsive force between the magnets 40 and 42, causes the actuator magnet 40 to be held in its last-selected position until manual force is applied to the rocker actuator 16 sufficient to overcome the magnetic repulsive force between the magnets 40 and 42.

In this embodiment, a single-pole magnet arrangement is used. Thus, it should be understood that on the magnet 42, a corresponding south pole has magnetic flux flowing in the direction of the movable contact 36. Consequently, by constructing the switch with the magnet 42 close to the contacts 32, 34, 36, the magnetic field emanating from the south pole of the magnet 42 will act to quench any arcing at the contacts 32, 34, 36 and reduce arcing problems such as radio interference. This feature will also limit pitting or other associated deterioration of the contacts 32, 34, 36.

Figure 4:
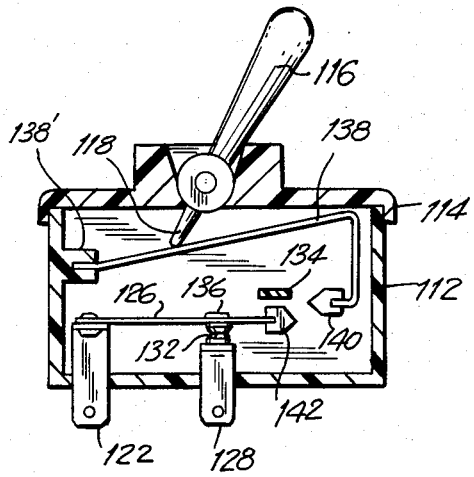
FIGS. 4 and 5 are sectional views of a toggle switch according to this invention.
Figure 5:
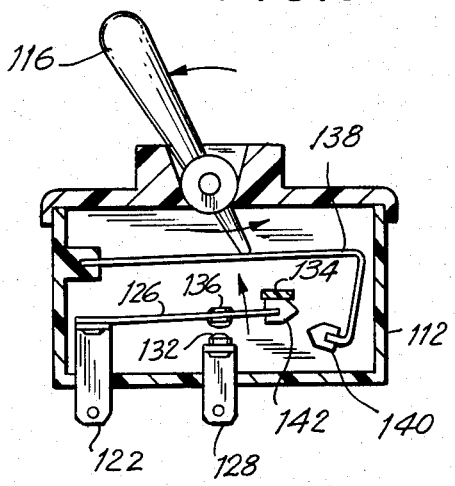

FIGS. 4 and 5 illustrate a possible configuration of a bat-handle toggle switch 110 embodying this invention. In this toggle switch, a generally hollow insulating housing body 112 has a cover 114 at an open end thereof, in which an actuator bat 116 is pivotally mounted. A nose 118 of the actuator bat 116 projects into the interior of the housing body 112. A first terminal 122 extends from the exterior to the interior of the housing body 112 and thereby serves as a mount for a flexible resilient conductive blade 126. A second terminal 128 also extends from the exterior to the interior of the housing 112 and provides a mount for a fixed contact 132 disposed beneath the blade 126. A projection 134 within the housing body 112 serves to limit upward travel of the blade 126, while the contact 132 limits downward travel thereof.

A movable contact 136 mounted on the blade 126 engages the contact 132 when the blade is in one position thereof (FIG. 4), but is out of engagement with the contact 132 when the blade 126 is in another position (FIG. 5).

An L-shaped resilient arm 138 has one end affixed to a mounting 138' within the housing body 112, and has an actuator magnet 140 disposed at the free end thereof. A blade magnet 142 is disposed at the free end of the blade 126. These magnets 140 and 142 face one another in a fashion similar to that of the rocker switch of FIGS. 1–3, and their function is the same as in that switch. Consequently, when the bat 116 is moved between the positions illustrated in FIG. 4 and FIG. 5, the arm 138 is deflected in response to movement of the nose 118. Accordingly, the actuator magnet 140 moves downwardly, and the driven magnet 142 is repelled upwards, thereby snapping the blade 126 to the open position of FIG. 5.

When the bat 116 is moved back from the FIG. 5 position to that of FIG. 4, the actuator magnet 140 returns upward, causing the blade magnet 142 to be repelled downward, thereby snapping the blade 126 to the closed position of FIG. 4.

Figure 6:
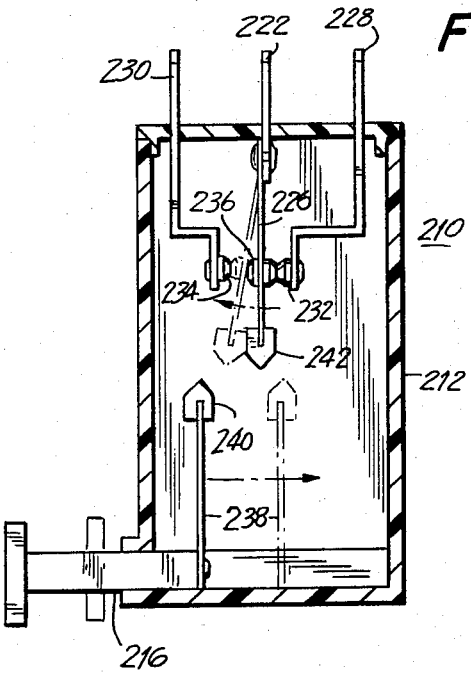
FIG. 6 shows a plunger switch according to this invention.

A two-position plunger switch 210 can generally be constructed as illustrated in FIG. 6. In this switch, a plunger actuator 216 is selectively slidable between a first position (solid lines) and a second position (ghost lines) within a housing body 212. Here, a common terminal 226 extends through the housing body 212 and a blade 226 is mounted thereon. First and second switched terminals 228 and 230 also extend into the interior of the housing body 212 and have contacts 232, 234 on opposite sides of the blade 226.

An actuator arm 238 is mounted on the plunger 216 and holds an actuator magnet 240 in close proximity to and generally facing a blade magnet 242 disposed at the free end of the blade 226.

The operation of this switch 210 is functionally similar to that of the preceding switches. When the plunger actuator 216 is moved from its solid line to its ghost-line position, the blade 226 is correspondingly moved, with snap-motion, from its solid-line to its ghost-line position.

Figure 7:
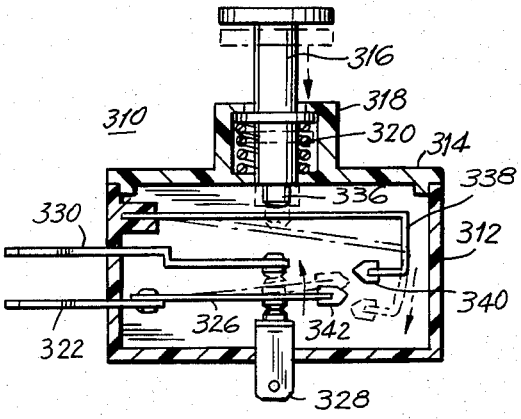
FIG. 7 shows a momentary-contact switch according to this invention.

An illustrative version of a momentary-contact switch 310 embodying this invention is shown in FIG. 7. In this momentary-contact switch, a housing body 312 and a cover 314 are provided, with a push-button actuator 316 being mounted in a casing 318 on the latter. A spring 320 within the casing 318 resiliently biases the push-button actuator 316 to a normal position. A common terminal 322 extends through the housing body 312 and supports a conductive blade 326. Similarly, a normally-closed terminal 328 and a normally-open terminal 330 also extend through the housing body 312.

A nose 336 on the push-button actuator 316 mechanically contacts an L-shaped actuator arm 338 to deflect the same between the positions shown in solid and ghost lines in FIG. 7. An actuator magnet 340 disposed at the end of the actuator arm 338 causes a blade magnet 342 mounted on a free end of the blade 326 to be deflected to corresponding positions shown in solid and ghost lines, respectively.

Thus, when the push-button actuator 316 is in its normal, raised position, the common terminal 322 and the normally-closed terminal 328 are electrically engaged. However, when the push-button actuator 316 is depressed, the common terminal 322 and the normally-open terminal 330 are electrically engaged.

Figure 8:
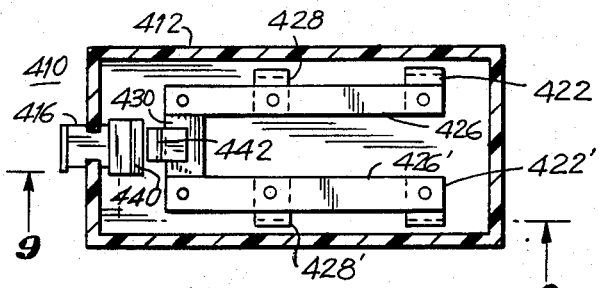
FIGS. 8 and 9 are a plan view and a partial elevational view of a two-pole slide switch according to this invention.
Figure 9:
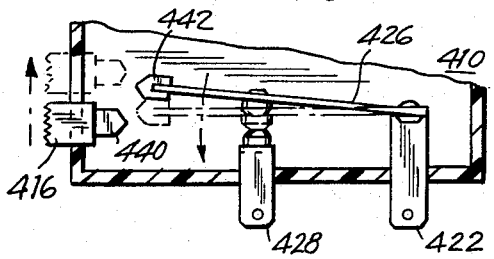

A two-position slide switch 410 is illustrated in FIGS. 8 and 9. A housing 412 generally encloses the slide switch, and a slide actuator 416 is selectively movable upwardly and downwardly in an elongated slot 418 in the housing 412. This slide switch 410 is further arranged as a double-pole switch, and has first and second terminals 422 and 422' extending through the housing to the interior thereof to serve as mounts for a pair of blades 426 and 426', respectively, arranged side by side. Third and fourth terminals 428 and 428' extend through the housing 412 for selectively contacting the respective blades 426 and 426'. Here, an insulator 430 joins the free ends of the blades 426 and 426'. An actuator magnet 440 mounted on the slide actuator 416 serves to drive a blade magnet 442 which is mounted on the insulator 430.

FIG. 10 illustrates yet another switch 510, which utilizes ceramic magnets of generally round cross section.

In this switch 510, a housing 512 generally surrounds the switch members, and a slide actuator 516 extends through the housing 512 and is mounted for sliding movement with respect thereto.

A common terminal 522 extends through the housing 512 and supports a blade 526, while first and second switched terminals also extend through the housing 512 and are respectively disposed above and below the blade 526. A bight 538 formed in the actuator 516 holds a round ceramic magnet 540, while another round ceramic magnet 542 is mounted at the free of the blade 526.

FIG. 11 shows one possible alternative construction of the actuator and blade magnets of this invention. In this arrangement, ceramic magnets 40' and 42' are each formed with a generally wedge-shaped pole, and angled chrome steel or other high-permeability-material pole pieces 40'a and 42'a cover the poles of the respective ceramic magnets 40' and 42'. This structure tends to concentrate the magnetic flux so that the latter emanates from ridges of the pole pieces 40'a and 42'a. Consequently, a strong toggle action results when the magnets 40' and 42' are used as the actuator and blade magnets, respectively.

FIG. 12 illustrates an alternative arrangement of the switch magnets which can be used in any of the foregoing embodiments of this invention. Here, an actuator magnet 40'', mounted on the actuator arm 38, has north and south poles 40''N and 40''S formed one above the other on a longitudinal side thereof. A blade magnet 42'', mounted on the blade 26, is similarly provided with north and south poles 42'N and 42''S disposed one above the other and generally facing the like poles 40''N and 40''S of the actuator magnet 40''. These poles 40''N, 40''S and 42''N, 42''S are disposed in line in the general direction of motion of the actuator arm 38 and the blade 26, respectively. The operation of the switch incorporating the magnets 40'' and 42'' is generally similar to that described hereinabove. However, it should be noticed that one of the poles, for example, 42''N of the driven or blade magnet 42'', will be disposed between the two poles 40''N and 40''S of the actuator magnet 40''. Consequently, not only are the poles of the blade magnet 42'' repelled by the like poles of the actuator magnet 40'', but at least one pole of the blade magnet 42'' is additionally attracted by the unlike pole of the actuator magent 40'', and the blade 26 is consequently snapped to, and held more securely in the desired switched position. The magnets 40'' and 42'' can be unitarily formed of ceramic or other permanent-magnet material.

Alternatively, as shown, for example, in FIG. 13, a dual actuator magnet assembly 640 and a dual blade magnet assembly 642 can each be formed of respective ceramic bar magnets 644 and 646 having generally L-shaped pole pieces 644N, 644S, and 646N, 646S wherein each pole piece faces a corresponding pole piece (of like polarity) of the other magnet 646, 644.

Another similar arrangement is illustrated in FIG. 14, showing the connection of magnet assemblies 740 and 742 to an actuator arm 738 and a blade 726. Here, the blades 738 and 726 have respective C-shaped bights formed therein in which the magnet assemblies 740 and 742 are respectively disposed. Prefereably, the blade 726 and also the arm 738 are formed of a non-magnetic material, such as brass. The magnet assemblies 740 and 742 are each formed of a respective ceramic bar magnet 744 and 746, similar to that of the FIG. 13 arrangement, but here flat pole pieces 744N, 744S and 746N, 746S are respectively disposed thereon.

FIG. 15 shows yet another alternative arrangement, similar to that of FIG. 14, but wherein the blade arrangement is formed of upper and lower blade leaves 726' and 726'' which are welded or riveted together.

In the above description, terms of orientation, such as "upwardly" or "down" are intended to indicate direction only with respect to the drawings. Switches according to this invention can, of course, be oriented in any arbitrary direction.

While certain preferred embodiment of this invention have been illustrated and described hereinabove, many possible embodiments and variations thereof will be apparent to persons of ordinary skill without departure from the scope and spirit of this invention, as defined in the appended claims.

What is claimed is:

1. A magnetically actuated switch comprising first and second terminals; a first contact connected to said first terminal; a second contact connected to said second terminal; movable support means movable between a first position wherein said first and second contacts are engaged and a second position wherein said first and second contacts are disengaged; a driven magnet affixed to and movable with said movable support means; movable actuator means selectively movable between first and second positions corresponding to the first and second positions of said movable support means; and an actuator magnet affixed onto and movable with said actuator means, with said actuator magnet and said driven magnet having like poles in generally facing arrangement, said poles having wedge-shaped pole pieces with noses thereof facing one another, and disposed such that when said actuator means is in said first and second positions thereof, the actuator magnet is positioned beyond the position of said driven magnet when said support means is in its first and second positions, respectively, and when said actuator means is moved to its first and second positions, said driven magnet is repulsed by said actuator magnet to drive said movable support means to its respective second and first positions.

2. A magnetically actuated switch comprising a pair of switched terminals and a common terminal; a pair of switched contacts respectively connected to said switched terminals and a common contact connected to said common terminal; movable support means movable a limited distance between a first position, wherein said common contact is electrically engaged with one of said switched contacts and disengaged with the other thereof, and a second position, wherein said common contact is electrically engaged with said other and disengaged with said one of said switched contacts; a driven magnet affixed to and movable with said movable support means; a movable actuator selectively movable between first and second positions corresponding to the first and second positions of said movable support means; and an actuator magnet affixed onto and movable with said actuator means, with said actuator magnet and said driven magnet having like poles in generally facing arrangement, said poles having wedge-shaped pole pieces with noses thereof facing one another, such that when said actuator is in said first and second positions thereof, one pole of the actuator magnet is beyond the position of the like pole of the driven magnet when said support means is in its first and second positions, respectively, and when said actuator is moved to one of its first and second positions, said driven magnet is repulsed by said actuator magnet to drive said movable support means to the other of its respective first and second positions.

3. A magnetically actuated switch comprising a housing; a conductive flexible blade mounted in said housing having a free end and a fixed end held in a blade support in said housing; a movable contact affixed to said blade; a fixed contact fixedly supported in said housing and contacting said movable contact when said blade is in a first position thereof; means limiting flexible movement of said blade between said first position and a second position wherein said fixed contact and said movable contact are out of contact with one another; a driven magnet mounted on the free end of said blade; a movable actuator mounted on said housing and selectively movable between first and second positions corresponding to the first and second positions of said blade; and an actuator magnet affixed onto and movable with said actuator means, with said actuator magnet and said driven magnet having like poles in a generally facing arrangement, said poles having wedge-shaped pole pieces with noses thereof facing one another, such that when said actuator means is in said first and second positions thereof, one pole of the actuator magnet is beyond the position of the like pole of the drive magnet when said blade is in its respective first and second positions, and when said actuator means is moved to one of its first and second positions, said driven magnet is repulsed by said actuator magnet to drive said blade to the other of its respective first and second positions.

4. A magnetically actuated switch according to claim 3, wherein said blade is resiliently flexible.

5. A magnetically actuated switch according to claim 3, wherein said means limiting movement of said blade includes a second fixed contact disposed to engage said movable contact when said blade is in its second position.

6. A magnetically actuated rocker switch comprising a housing; a switched terminal and a common terminal each disposed outside said housing and extending into the interior thereof; a rocker actuator pivotally disposed on said housing and rockable between first and second positions; a conductive blade having a free end and a fixed end mounted within said housing and connected to said common terminal; a movable contact disposed on said blade; a fixed contact mounted in said housing and connected to said switched terminal; means limiting flexible movement of said blade between a first position in which said movable contact engages said fixed contact and a second position in which said movable contact is out of engagement with said fixed contact; an actuator magnet mounted on and movable with said rocker actuator; and a driven magnet affixed to and movable with the free end of said blade; with the actuator magnet and the driven magnet having like poles generally facing one another, said poles having wedge-shaped pole pieces with noses thereof facing one another, and disposed such that when said actuator is rocked into said first and second positions thereof, one pole of the actuator magnet is disposed beyond the position of the like pole of the driven magnet when said blade is in its corresponding first and second positions, and when said actuator is rocked to one of its first and second positions, said driven magnet is repulsed by said actuator magnet to drive said blade to the other of its respective first and second positions.

7. A magnetically actuated rocker switch according to claim 6, wherein said means limiting flexible movement of said blade includes a second fixed contact mounted to engage said movable contact when said blade is in its second position, and a second switched terminal connected to said second fixed contact and extending to the exterior of said housing.

8. A magnetic toggle switch comprising a housing; first and second terminals extending from the exterior to the interior of said housing; a flexible conductive blade having a free end and a fixed end mounted within said housing and in contact with said first terminal; a fixed contact within said housing in contact with said second terminal; a movable contact disposed on said blade and engageable with said fixed contact when said blade is in a first position; means limiting flexible motion of said blade between said first position and a second position in which said fixed contact and said movable contact are out of engagement; an actuator handle disposed in said housing and having a portion extending inside said housing, the handle being selectively movable between first and second toggle positions; actuator arm means contacting said portion of the actuator handle and movable between corresponding first and second positions in response to movement of said actuator handle; an actuator magnet mounted on said actuator arm means and movable therewith; and a driven magnet affixed to and movable with the free end of said blade; with the actuator magnet and the driven magnet having like poles, said poles having wedge-shaped pole pieces with noses thereof facing one another, and disposed such that when said actuator handle is toggled into its first and second positions, the pole of the actuator magnet is disposed beyond the position of the like pole of the driven magnet when said blade is in its corresponding first and second positions, and when said actuator handle is moved to one of its first and second toggle positions, said driven magnet is repulsed by said actuator magnet to drive said blade to the other of its respective first and second positions.

9. A magnetic toggle switch according to claim 8, wherein said actuator arm means includes a resiliently flexible L-shaped member having one end affixed in said housing and another end on which said driven magnet is mounted.

10. A two-position plunger switch comprising a housing; first and second terminals extending from the exterior of the interior of said housing; a flexible conductive blade having a free end and a fixed end mounted within said housing and in contact with said first terminal; a fixed contact within said housing in contact with said second terminal; a movable contact disposed on said blade and engageable with said fixed contact when said blade is in a first position; means limiting flexible motion of said blade between said first position and a second position in which said fixed contact and said movable contact are out of engagement; plunger means actuable from outside said housing and slideable within said housing between first and second positions; an actuator magnet mounted on said plunger means and movable therewith; and a driven magnet affixed to and movable with the free end of said blade; with the actuator magnet and the driven magnet having like poles generally facing one another, said poles having wedge-shaped pole pieces with noses thereof facing one another, and disposed such that when said plunger means has slid to its first and second positions, one pole of the actuator magnet is disposed beyond the like pole of the driven magnet when said blade is in its corresponding first and second positions, and when said plunger means slides to either one of its first and second positions, said driven magnet is repulsed by said actuator magnet to drive said blade to the other of its respective first and second positions.

11. A two-position plunger switch comprising a housing; a common terminal and first and second switched terminals extending from the exterior to the interior of said housing; a flexible conductive blade having a free end and a fixed end mounted within said housing and in contact with said common terminal; first and second fixed contacts within said housing and in contact with said first and second terminals, respectively; a movable contact disposed on said blade and engageable with said first and second fixed contacts when said blade is flexibly moved to respective first and second positions thereof; plunger means actuable from outside said housing and slidable within said housing between first and second positions; an actuator magnet mounted on said plunger means and movable therewith; and a driven magnet affixed to and movable with the free end of said blade, with the actuator magnet and the driven magnet having like poles generally facing one another, said poles having wedge-shaped pole pieces with noses thereof facing one another, and disposed such that when said plunger means slides to its first and second positions, one pole of the actuator magnet is disposed beyond the like pole of the driven magnet when said blade is in its corresponding first and second positions, and when said plunger means slides to either one of its first and second positions, said driven magnet is repulsed by said actuator magnet to drive said blade to the other of its respective first and second positions.

12. A momentary contact switch comprising a housing; first and second terminals extending from the exterior to the interior of said housing; a flexible conductive blade having a free end and a fixed end mounted within said housing and in contact with said first terminal; a fixed contact within said housing in contact with said second terminal; a movable contact disposed on said blade and engageable with said fixed contact when said blade is in a first position thereof; means limiting flexible motion of said blade between said first position and a second position in which said fixed contact and said movable contact are out of engagement; an actuator button mounted on said housing and extending to the interior thereof, the actuator button being resiliently mounted so that it is normally disposed in a first position but can be selectively depressed to a second position; an actuator magnet; means mounting said actuator magnet to move with said actuator button; and a driven magnet affixed to and movable with the free end of said blade; with the actuator magnet and the driven magnet having like poles generally facing one another, said poles having wedge-shaped pole pieces with noses thereof facing one another, and disposed such that when said actuator button is manually actuated to move between its first and second positions, one pole of the actuator magnet is correspondingly moved beyond the positions of the like pole of the driven magnet when said blade is in corresponding ones of its first and second positions, and when said actuator button is so actuated, said driven magnet is repulsed by said actuator magnet to drive said blade to an opposite one of its first and second positions.

13. A momentary contact switch comprising a housing; a common terminal, a normally-closed terminal, and a normally-open terminal, each extending from the exterior to the interior of said housing; a flexible conductive blade having a free end and a fixed end mounted within said housing and in contact with said common terminal; first and second fixed contacts within said housing respectively in contact with said normally-open and said normally-closed terminals; a movable contact disposed on said blade and engageable with said first and second fixed contacts when said blade is flexibly moved to respective first and second positions thereof; an actuator button mounted on said housing and extending to the interior thereof, said actuator button being resiliently mounted so that it is normally disposed in a first position but can be selectively depressed to a second position; an actuator magnet; means mounting said actuator magnet to move with said actuator button; and a driven magnet affixed to and movable with the free end of said blade; with the actuator magnet and the driven magnet having like poles generally facing one another, said poles having wedge-shaped pole pieces with noses thereof facing one another, and disposed such that when said actuator button is manually actuated to move between its first and second positions, one pole of the actuator magnet is disposed beyond the position of the like pole of the driven magnet when said blade is in its corresponding first and second positions, and when said actuator button is so actuated to one of its first and second positions, said driven magnet is repulsed by said actuator magnet to drive said blade to the other of its respective first and second positions.

14. A slide switch comprising a housing; first and second terminals extending from the exterior to the interior of said housing; a flexible conductive blade having a free end and a fixed end mounted within said housing and in contact with said first terminal; a fixed contact within said housing in contact with said second terminal; a movable contact disposed on said blade and engageable with said fixed contact when said blade is in a first position thereof; means limiting flexible motion of said blade between said first position and a second position in which said fixed contact and said movable contact are out of engagement; a slide actuator slidable in a slot in said housing between first and second positions; and actuator magnet mounted on said slide actuator and movable therewith; and a driven magnet affixed to and movable with the free end of said blade; with the actuator magnet and the driven magnet having like poles generally facing one another, said poles having wedge-shaped pole pieces with noses thereof facing one another, and disposed such that when said slide actuator is slid to its first and second positions, one pole of the actuator magnet is disposed beyond the like pole of the driven magnet when said blade is in its corresponding first and second positions, and when the slide actuator moves to either one of its first and second positions, said driven magnet is repulsed by said actuator magnet to drive said blade to the other of its respective first and second positions.

15. A magnetically actuated switch comprising a housing; a pair of conductive flexible blades mounted in said housing, each having a free end and a fixed end held in a blade support in said housing; respective movable contacts affixed to each such blade; respective fixed contacts fixedly supported in said housing and each contacting its associated movable contact when said blades are in a first position thereof; means limiting flexible movement of said blades between said first position and a second position wherein said fixed contacts are out of contact with one another; means connecting said blade to move in concert between said first and second positions; a driven magnet mounted at the free ends of said blades; a movable actuator mounted on said housing and selectively movable between first and second positions corresponding to the first and second positions of said blades; and an actuator magnet affixed onto and movable with said actuator means, with said actuator magnet and said driven magnet having like poles, said poles having wedge-shaped pole pieces with noses thereof facing one another, such that when said actuator means is in said first and second positions thereof, one pole of the actuator magnet is beyond the position of the like pole of the driven magnet when the blades are in their respective first and second positions, and when said actuator means is moved to one of its first and second positions, said driven magnet is repulsed by said actuator magnet to drive said blades to the other of their respective first and second positions.

16. A magnetically actuated switch according to claim 15, wherein said blades are disposed in a parallel, side-by-side arrangement.

17. A magnetically actuated switch according to claim 15, wherein said means connecting said blades to move in concert includes insulating means electrically isolating said blades from one another.

18. A magnetically actuated switch comprising first and second terminals; a fixed contact connected to said first terminal; a movable contact connected to said second terminal; movable support means supporting said movable contact and movable between a first position wherein said fixed and movable contacts are engaged and a second position wherein said fixed and movable contacts are disengaged; a driven magnet affixed to and movable with said support means including a pole member of generally wedge-shaped cross section; movable actuator means selectively movable between first and second positions corresponding to the first and second positions of said support means; and an actuator magnet affixed onto and movable with said actuator means, including a pole member of generally wedge-shaped cross section, with the pole members of the driven and actuator magnets having like polarity and being arranged to have noses thereof generally facing each other, and disposed such that when said actuator means is in said first and second positions thereof, respectively, the pole member of said actuator magnet is positioned beyond the position of the pole member of the driven magnet when said support means is in its first and second positions, respectively, and when said actuator means is moved to one of its first and second positions, said driven magnet is repulsed by said actuator magnet to drive said support means to the other of its first and second positions.

19. A magnetically actuated switch comprising first and second terminals; a fixed contact connected to said first terminal; a movable contact connected to said second terminal; movable support means supporting said movable contact and movable between a first position wherein said fixed and movable contacts are engaged and a second position wherein said fixed and movable contacts are disengaged; movable actuator means selectively movable between said first and second positions corresponding to the first and second positions of said support means; an actuator magnet arrangement affixed onto and movable with said actuator means; and a driven magnet arrangement affixed to and movable with said support means for driving the same between said first and second positions thereof; each of said actuator magnet arrangement and said driven magnet arrangement including a north pole and a south pole arranged in line in the direction of motion of the associated magnet arrangement, and each such pole generally facing the like pole of the other magnet arrangement, and having a protruding pole member facing a respective protruding pole member on the other magnet arrangement, and disposed such that when said actuator means is in said first and second positions thereof, the poles of the actuator magnet arrangement are each positioned beyond the position of the corresponding like pole of the driven magnet arrangement when said support means is in its corresponding first and second positions, and when said actuator means is moved to one of its first and second positions, said driven magnet arrangement is repulsed by said actuator magnet arrangement to the other of its first and second positions, and one of the poles of the driven magnet arrangement is additionally attracted by the unlike pole of the actuator magnet arrangement and thereby held in said other position.

20. A magnetically actuated switch according to claim 19, wherein each said magnet arrangement includes a unitary magnet having generally wedge-shaped north and south pole structures formed along one side thereof with noses facing corresponding noses of the other magnetic arrangement.

21. A magnetically actuated switch according to claim 19, wherein each said magnet arrangement includes a bar magnet having protruding pole pieces attached to ends thereof with the protruding pole pieces facing corresponding protruding pole pieces of the other magnet arrangement.

22. A magnetically actuated switch comprising first and second terminals; a fixed contact connected to said first terminal; a movable contact connected to said second terminal; movable support means supporting said movable contact and movable between a first position wherein said fixed and movable contacts are electrically engaged and a second position wherein said fixed and movable contacts are disengaged; movable actuator means selectively movable between first and second positions corresponding to the first and second positions of said support means; an actuator magnet disposed on and movable with said actuator means; and a driven magnet affixed to and movable with said support means, with said actuator magnet and said driven magnet each having one pole facing a like pole of the other magnet, said poles having wedge-shaped pole pieces with the noses thereof facing one another, and disposed such that when said actuator means is moved between its first and second positions, said actuator magnet drives said driven magnet and the associated support means to the other of its first and second positions, and wherein said driven magnet and said movable contact are so disposed on said support means that flux emanating from an opposite pole of said driven magnet quenches electrical arcing between said fixed and movable contacts.

23. A magnetically actuated switch according to claim 1, wherein said noses of said wedge-shaped pole pieces are arranged with ridges disposed transversely to the direction of motion of said magnets.

24. A magnetically actuated switch according to claim 2, wherein said noses of said wedge-shaped pole pieces have ridges disposed transversely to the direction of motion of said magnets.

25. A magnetically actuated switch according to claim 3, wherein said noses of said wedge-shaped pole pieces have ridges disposed transversely to the direction of motion of said magnets.

26. A magnetically actuated rocker switch according to claim 6, wherein said noses of said wedge-shaped pole pieces have ridges disposed transversely to the direction of motion of said magnets.

27. A magnetically actuated rocker switch according to claim 8, wherein said noses of said wedge-shaped pole pieces have ridges disposed transversely to the direction of motion of said magnets.

28. A two-position plunger switch according to claim 10, wherein said noses of said wedge-shaped pole pieces have ridges disposed transversely to the direction of motion of said magnets.

29. A two-position plunger switch according to claim 11, wherein said noses of said wedge-shaped pole pieces have ridges disposed transversely to the direction of motion of said magnets.

30. A momentary contact switch according to claim 12, wherein said noses of said wedge-shaped pole pieces have ridges disposed transversely to the direction of motion of said magnets.

31. A momentary contact switch according to claim 13, wherein said noses of said wedge-shaped pole pieces have ridges disposed transversely to the direction of motion of said magnets.

32. A slide switch according to claim 14, wherein said noses of said wedge-shaped pole pieces have ridges disposed transversely to the direction of motion of said magnets.

33. A magnetically actuated switch according to claim 15, wherein said noses of said wedge-shaped pole pieces have ridges disposed transversely to the direction of motion of said magnets.

34. A magnetically actuated switch according to claim 18, wherein said noses of said pole members have ridges disposed transversely to the direction of motion of said magnets.

35. A magnetically actuated switch according to claim 19, wherein said protruding pole members extend transversely to the direction of motion of said magnets.

36. A magnetically actuated switch according to claim 22, wherein said noses of said wedge-shaped pole pieces have ridges disposed transversely to the direction of motion of said magnets.

* * * * *